US006994084B2

(12) United States Patent
Kuo

(10) Patent No.: US 6,994,084 B2
(45) Date of Patent: Feb. 7, 2006

(54) ANTI-SURF HEAD ON DRY-TYPE SNORKEL

(76) Inventor: Tzong-Fuh Kuo, No. 21, Alley 5, Lane 49, How Gaang 1st Rd., Hsin Juang City, Taipei Hsien (TW)

( * ) Notice: Subject to any disclaimer, the term of this patent is extended or adjusted under 35 U.S.C. 154(b) by 110 days.

(21) Appl. No.: 10/824,077

(22) Filed: Apr. 13, 2004

(65) Prior Publication Data

US 2005/0224077 A1 Oct. 13, 2005

(51) Int. Cl.
*B63C 11/16* (2006.01)
*B63C 11/02* (2006.01)

(52) U.S. Cl. ..... 128/201.11; 128/201.27; 405/186

(58) Field of Classification Search ..... 128/200.29, 128/201.11, 201.26, 201.27, 201.28, 206.29, 128/201.25; 405/186, 187; 181/21, 127
See application file for complete search history.

(56) References Cited

U.S. PATENT DOCUMENTS 5,117,817 A * 6/1992 Lin et al. ..... 128/201.11
6,679,253 B1 * 1/2004 Feng et al. ..... 128/201.11
6,843,246 B2 * 1/2005 Shiue et al. ..... 128/201.11

FOREIGN PATENT DOCUMENTS

WO WO 94/29167 * 12/1994

* cited by examiner

*Primary Examiner*—Teena Mitchell
(74) *Attorney, Agent, or Firm*—Pro-Techtor International Services

(57) ABSTRACT

The present invention relates to an anti-surf head on a dry-type snorkel, including a buoy formed on a lateral, an air chamber formed in a lid to increase buoyancy, thereby keeping an upright floating to prevent the buoy from fast shutting off or prevent seawater from entering the snorkel easily, and a set of guiding groove formed on a bottom of a partition to facilitate draining water out of the snorkel without causing retro-flow.

2 Claims, 4 Drawing Sheets

ANTI-SURF HEAD ON DRY-TYPE SNORKEL

BACKGROUND OF THE INVENTION (a) Field of the Invention

The present invention relates to an improved anti-surf head. Its peculiar structures are formed by an air chamber formed in a lid to keep an upright floating and by guiding grooves formed on a bottom of a partition to facilitate draining water out of a snorkel.

The dry-type snorkel prevents seawater from entering the snorkel by forming a buoy in a chamber, which can shut a water inlet hole off when floating.

(b) Description of the Prior Art

Referring to FIGS. 1–4. Common deficiencies in conventional anti-surf heads 100, 200, 300, and 400, each with a vertically positioned buoy 101, 201, 301, and 401, respectively, are as follows, 1. A water inlet hole is easy to shut off when an excessive slant of the anti-surf head occurs, thereby affecting a smooth breathing.
2. Seawater is easy to enter a snorkel when shutting off of the buoy is not quickly enough against high surf.
3. Partial retro-flow caused by a blockage of a lid can be formed when draining water out of the snorkel, thereby adding much effort to drain water.

SUMMARY OF THE INVENTION

The present invention relates to an anti-surf head. Its peculiar structures are formed by an air chamber formed in a lid to keep an upright floating, thereby preventing a buoy from fast shutting off or preventing seawater from entering a snorkel easily, and also by guiding grooves formed on a bottom of a partition to facilitate draining water out of the snorkel without causing retro-flow.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 3:
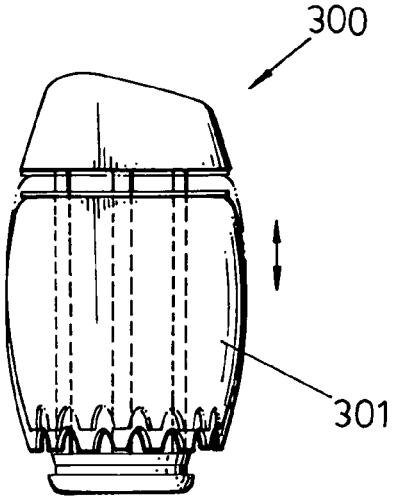
FIG.3 (PRIOR ART)
FIG. 3 shows a perspective view of another conventional anti-surf head.
Figure 1:
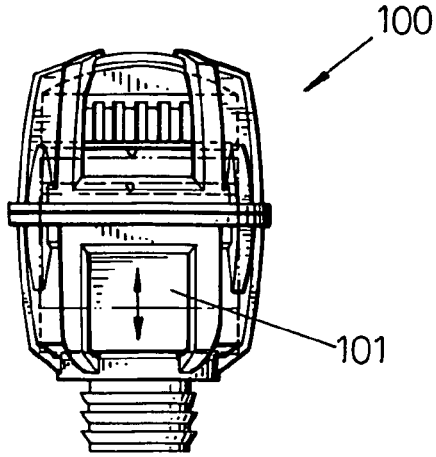
FIG.1 (PRIOR ART)
FIG. 1 shows a perspective view of a conventional anti-surf head.
Figure 2:
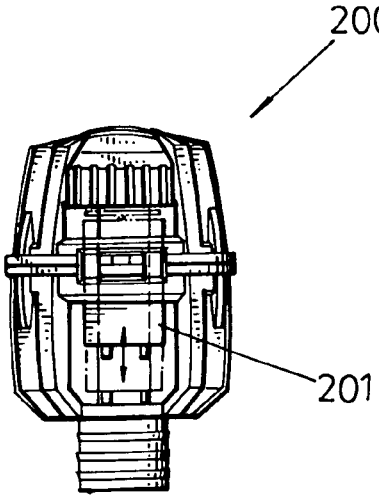
FIG.2 (PRIOR ART)
FIG. 2 shows a perspective view of another conventional anti-surf head.
Figure 4:
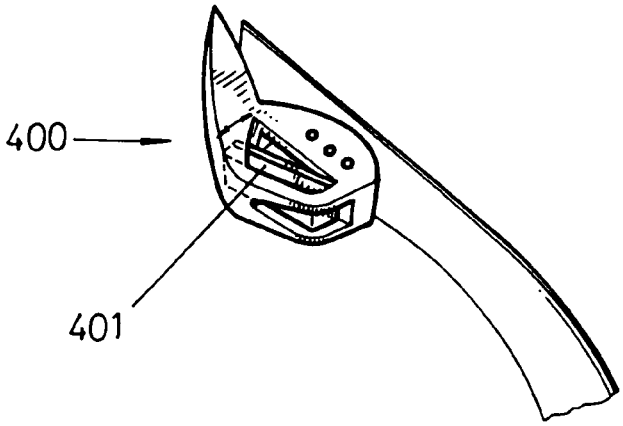
FIG.4 (PRIOR ART)
FIG. 4 shows a perspective view of another conventional anti-surf head.
Figure 5:
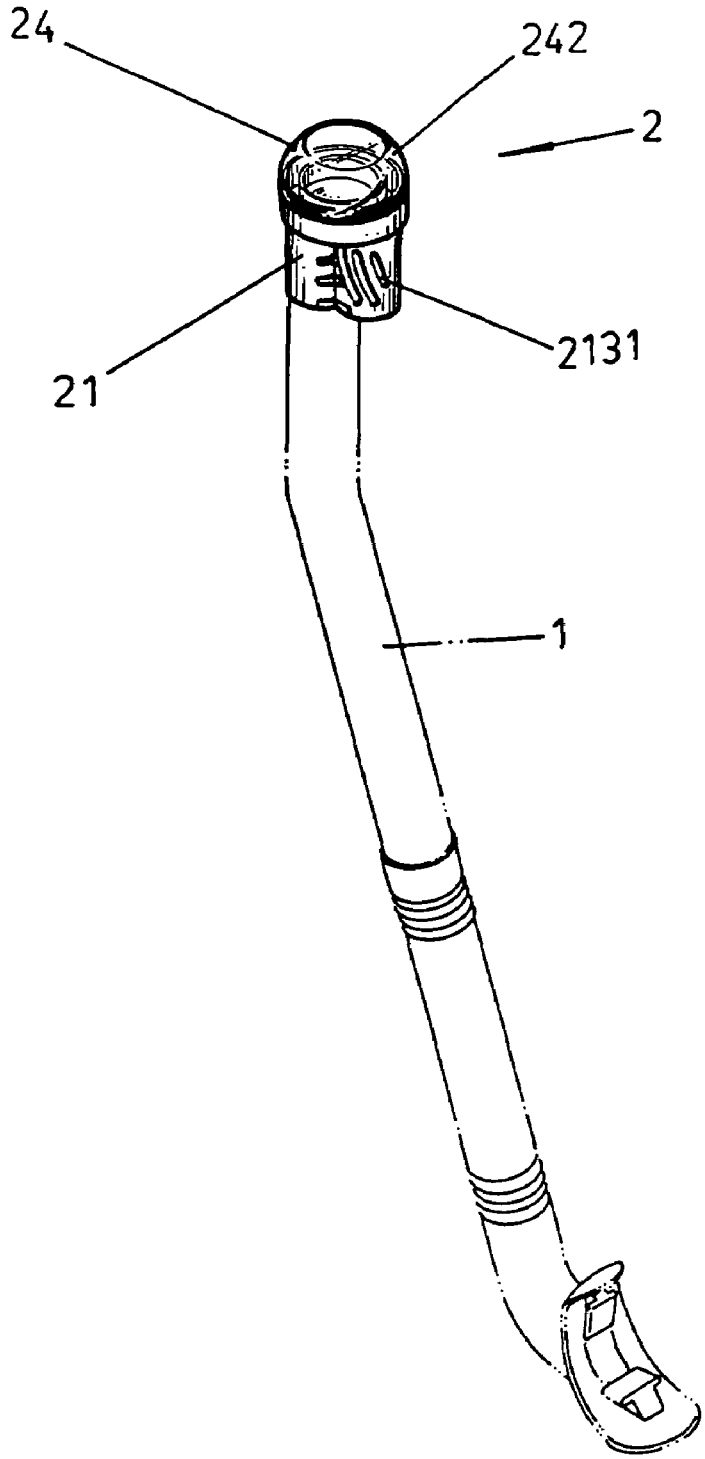
FIG. 5 shows a perspective view of the present invention.
Figures 6, 7:
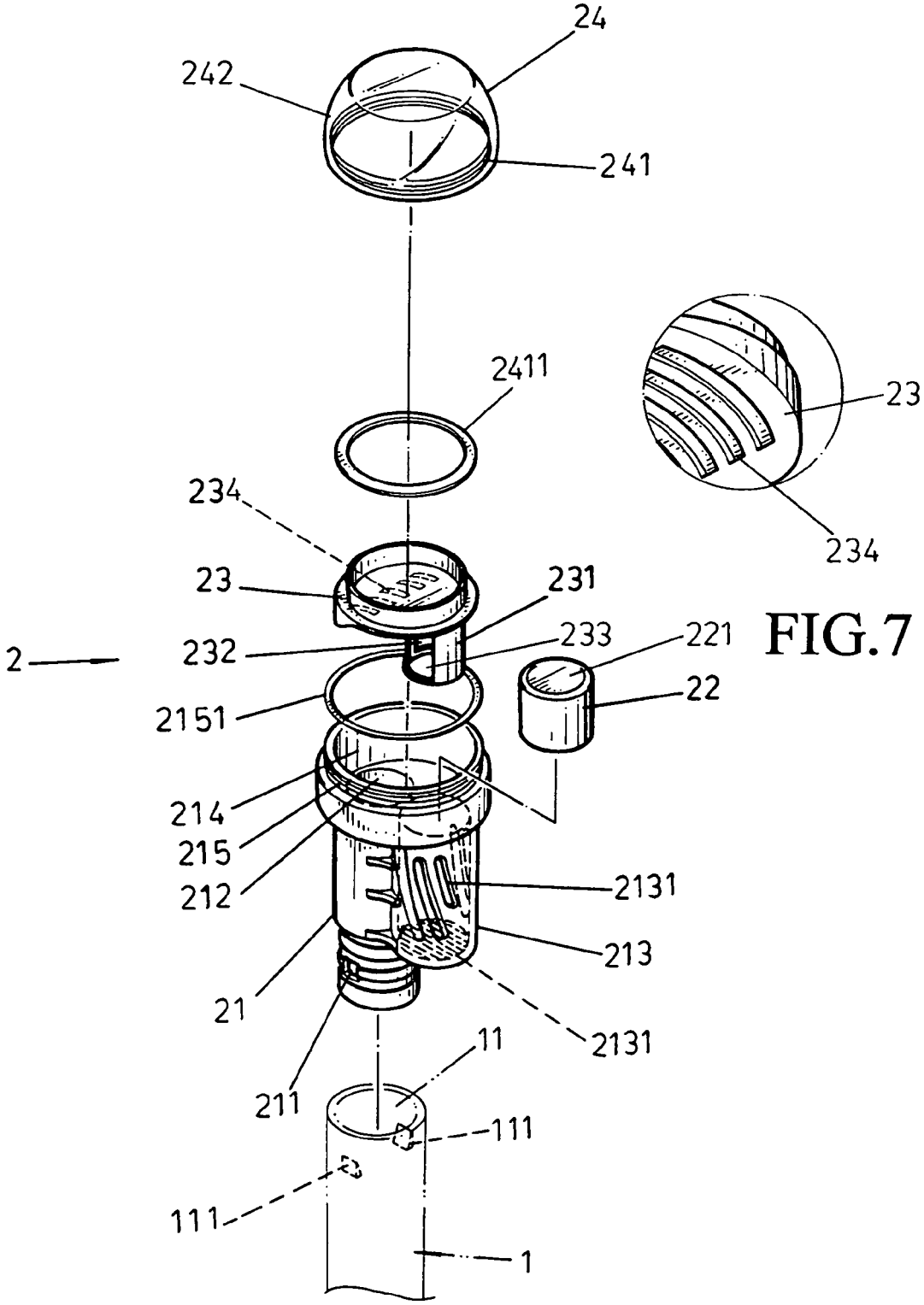
FIG. 6 shows an exploded elevational view of the present invention.
FIG. 7 shows a partition's bottom view of the present invention

Referring to FIGS. 5~8. The present invention is an anti-surf head 2 on a snorkel 1 comprising an anti-surf head body 21, wherein, two holes 211 formed on a bottom pipe to engaged with two tapers 111 formed on the inner perimeter of an end 11 on the snorkel 1;

a pipe 212 formed above the bottom pipe;

a chamber 213 formed adjacent to the pipe 212;

a cylinder container 214 formed atop the chamber 213 and the pipe 212 to connect between, wherein an external thread 215, with an anti-water O-ring 2151, formed atop an outer perimeter;

a buoy 22 formed inside the chamber 213, wherein, a packing 221 formed on a top and openings 2131 formed on a bottom and a lateral, thereby floating the buoy 22 when air or water flowing inside thereof;

a partition 23 formed on a bottom of the cylinder container 214, wherein, arced guiding grooves 234 formed on a bottom and a tube 231 extending inside the chamber 213 formed underneath, with a bottom opening 233 and a lateral opening 232, opening to the cylinder 214, formed thereof;

a lid 24 formed atop the anti-surf head 2, wherein, an air chamber 242 formed on a top and an internal thread 241, with an anti-water O-ring 2411, formed on an inner perimeter of a bottom to engage with the external thread 215 on the cylinder container 214.

Figure 8:
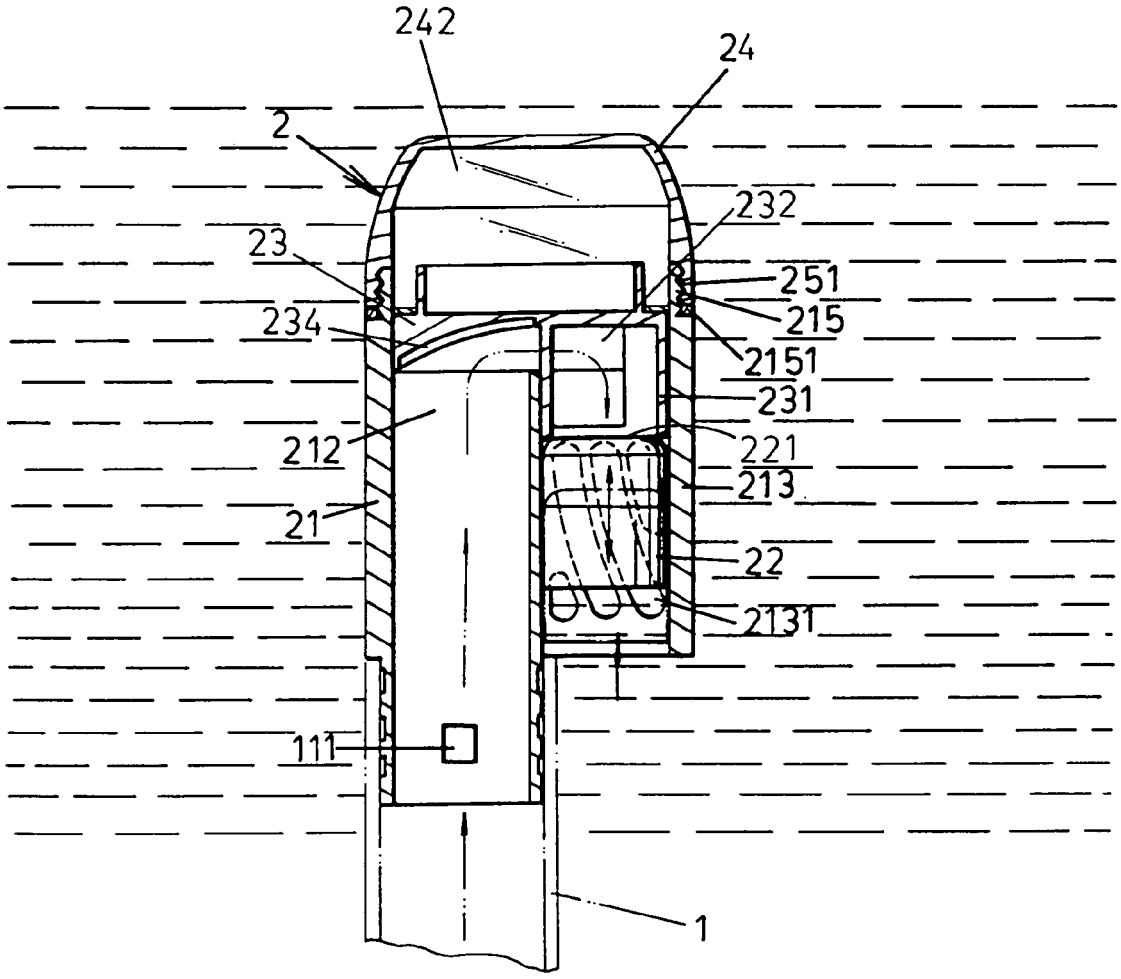
FIG. 8 shows a partition's cross-sectional view of the present invention.

Referring to FIG. 8. When diving, buoyancy of the buoy 22 will lift up the packing 221 to block openings 233 of the tube 231, thereby preventing water inside the chamber 213 from entering the pipe 212 and further flowing to an individual's mouth.

The air chamber 242 of the anti-surf head 2 increases buoyancy to keep the anti-surf head 2 an upright floating, thereby keeping a smooth breathing by preventing the buoy 22 from fast shutting off, due to an excessive inclination of the anti-surf head 2, or preventing seawater from entering the snorkel 1 easily.

Furthermore, with guiding grooves 234 on the partition 23, water draining from the pipe 212 to openings 2131 of the chamber 213 will be easy without causing retro-flow.

In summary, with the buoy forming beside the anti-surf head in the present invention, water can be drained easily from the snorkel. The air chamber increases buoyancy to keep the anti-surf head an upright floating, thereby keeping the smooth breathing by preventing the buoy from fast shutting off or preventing seawater from entering the snorkel easily. With guiding grooves, water draining from the snorkel will be easy without causing retro-flow.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. An anti-surf head for a snorkel comprising:

an anti-surf head body comprising an airflow tube, a tubular chamber with openings formed on a bottom and side thereof, a cylindrical compartment above the airflow tube and the tubular chamber, the cylindrical compartment including a threaded portion with an annular shoulder to provide a seating area for an O-ring, a cylindrical buoy contained in the tubular chamber, a partition element with arced guiding grooves therein, the partition element being contained in the cylindrical compartment, the partition element including a tube leading into the tubular chamber, the tube guiding water toward the openings in the tubular chamber to drain water out of the snorkel, and a lid threaded onto the top of the anti-surf head body and sealed with an O-ring, the lid being hemispherical so as to form an air chamber to increase buoyancy, thereby urging the snorkel toward an upright position.

2. The anti-surf head on the dry-type snorkel in accordance with claim 1, wherein the buoy is formed on a lateral side of the anti-surf head body.

* * * * *